United States Patent [19]

Kirchhoff, Jr.

[11] 4,383,563

[45] May 17, 1983

[54] GOLF BAG

[76] Inventor: Christian H. Kirchhoff, Jr., 108B Chestnut St., Millville, N.J. 08332

[21] Appl. No.: 287,626

[22] Filed: Jul. 28, 1981

[51] Int. Cl.[3] ..... A63B 55/00

[52] U.S. Cl. ..... 150/1.5 R; 150/1.5 C

[58] Field of Search ..... 150/1.5 R, 1.5 B, 1.5 C, 150/52 G; 190/18 A; 248/349; 280/147.34, DIG. 6; 273/32 R, 32 B, 32 E, 77 R

[56] References Cited

U.S. PATENT DOCUMENTS

| | | | |
|---|---|---|---|
| 2,596,578 | 5/1952 | McIntyre et al. | 190/18 A X |
| 2,605,989 | 8/1952 | Luft | 190/18 A X |
| 2,783,054 | 2/1957 | Stratton, Jr. | 280/DIG. 6 X |
| 2,879,819 | 3/1959 | Turnbull | 150/1.5 R |
| 3,373,911 | 3/1968 | Kebelbeck | 150/1.5 C X |
| 3,941,398 | 3/1976 | Nelson | 150/1.5 R X |
| 3,985,171 | 10/1976 | Summers et al. | 150/1.5 R X |
| 4,012,051 | 3/1977 | Embinder | 280/DIG. 6 X |
| 4,100,652 | 7/1978 | Carlson | 150/1.5 R X |
| 4,142,563 | 3/1979 | Ackerfeldt et al. | 150/1.5 R X |
| 4,319,616 | 3/1982 | Light | 150/1.5 C |

*Primary Examiner*—William Price
*Assistant Examiner*—Sue A. Weaver

[57] ABSTRACT

The full service golf bag includes a rigid body with a separate tube for the shaft of each club and a deck with cradles shaped to fit the respective club heads. The tubes are shaped to frictionally retain the clubs by their handgrips. An adjustable retainer clip for the putter is shown, as are specially designed compartments for all usual golfing accessories such as shoes, rake/retriever, thermos, umbrella, towel, balls and the like. A rigid, removable cover is provided over the upper end of the bag body. The lower end may include a rotatable base further provided with rollers useful for rolling the bag along airport concourses and the like.

32 Claims, 8 Drawing Figures

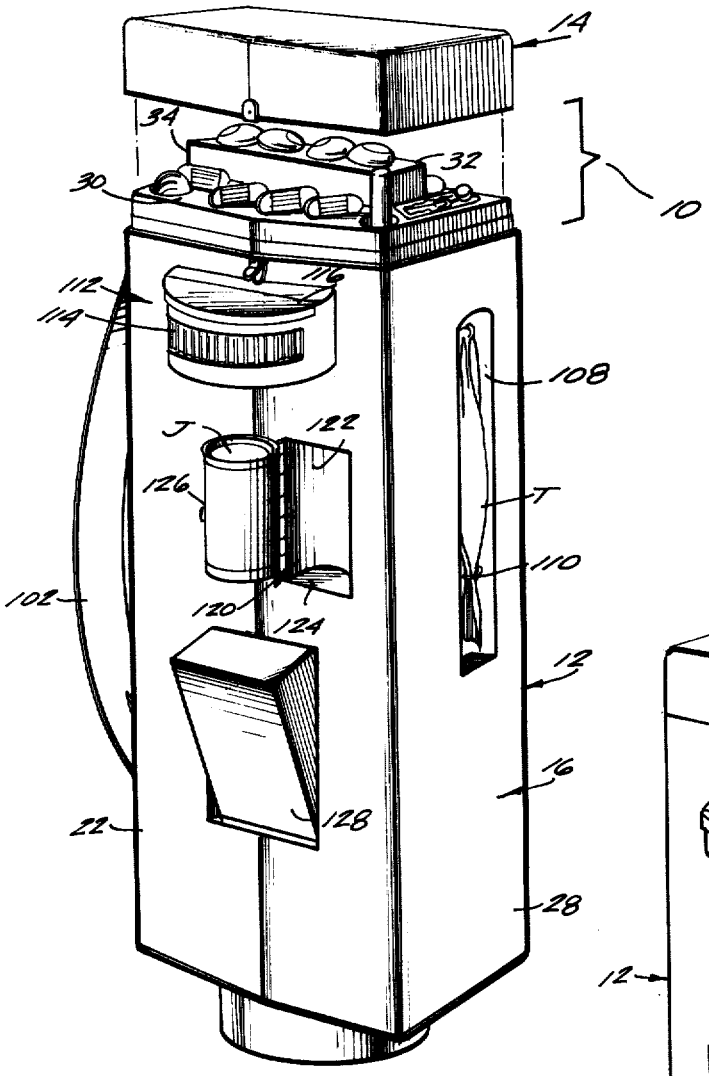
Fig. 1
Fig. 2
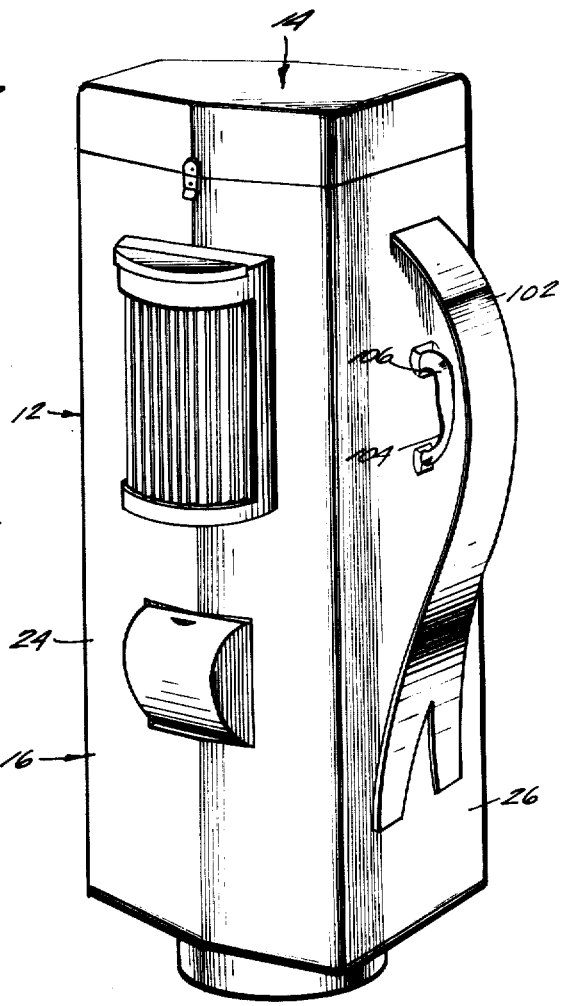

80
86
44
82
44
48
46
38
20
84
84
112
118
40
16
140
120
126
42
130
142
128
132
36
36
18
88
94

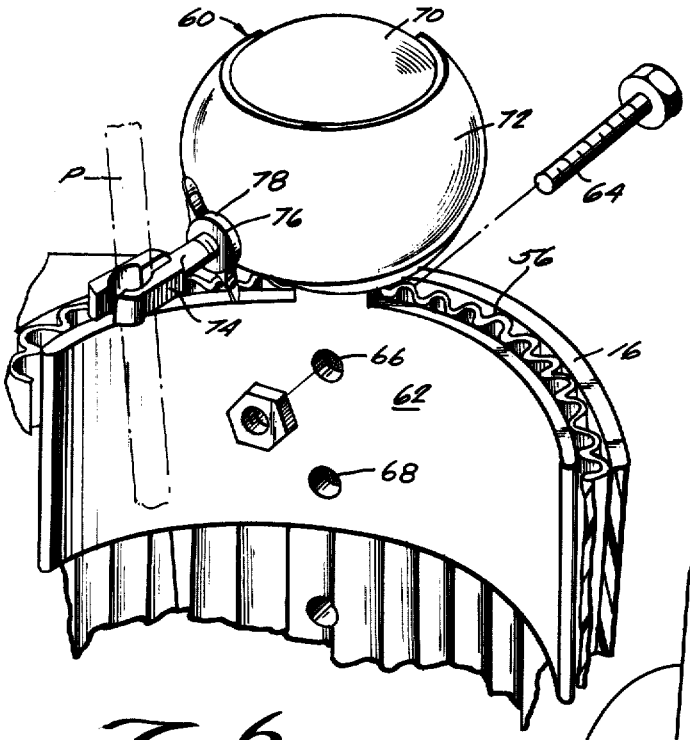
Fig. 6
Fig. 7
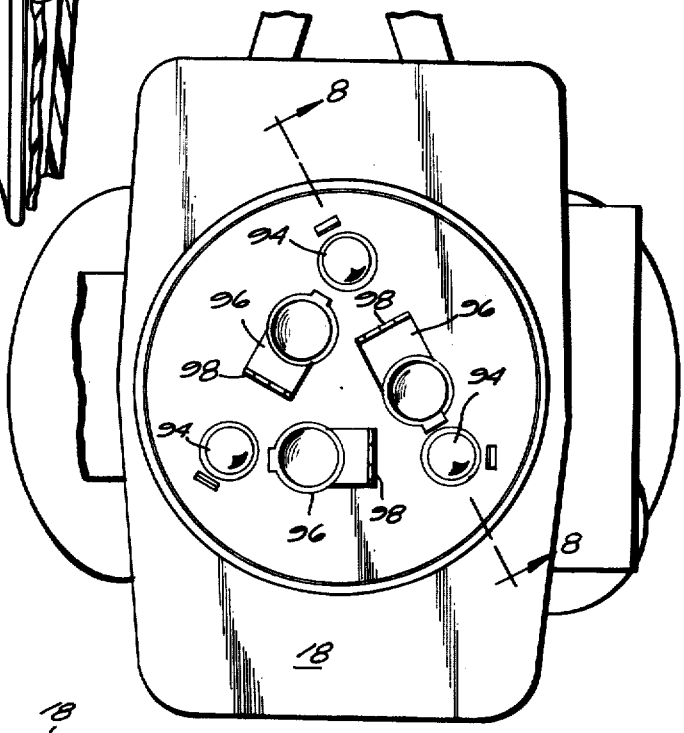
Fig. 8
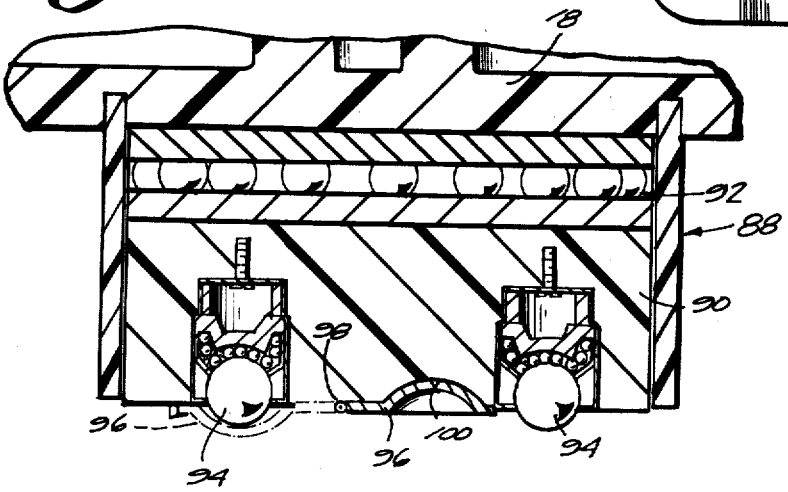

GOLF BAG

BACKGROUND OF THE INVENTION

Golf bags fall into two basic types that are designed on correspondingly different principles.

First is the lightweight bag, meant to be transported in hand or over the shoulder principally by a walking golfer. A principal design objective is to offer a bag that adds as little as possible to the weight of the barest essentials: a single sleeve for clubs, and usually a pocket for balls, tees, scorecard and pencil. Often the clubs are merely jumbled together with, at most, a crossbar at the bag mouth to separate the woods from the irons.

Second is the full service bag for the professional golfer, the travelling golfer and the golfer who principally uses a caddy or cart to transport it. Here, weight is less a consideration, expense is less a consideration and having everything at hand that the golfer may need or want is much more important.

Golfers who travel with their equipment by plane a lot are a special consideration, for they require a bag which can be subjected to rough treatment by baggage handlers that can be expected occasionally under the circumstances. Accordingly, some professional golfers heretofore have required a separate travelling case for completely enclosing their bag for off-the-course transport.

Further, no bag heretofore available has provided all the comforts a serious golfer could imagine.

SUMMARY OF THE INVENTION

The present invention provides a full service golf bag which also is suitable for off-the-course transport and handling as baggage without the need for a separate rigid enclosing case, and which obviates the need for mittens for the club heads.

The full service golf bag includes a rigid body with a separate tube for the shaft of each club and a deck with cradles shaped to fit the respective club heads. The tubes are shaped to frictionally retain the clubs by their handgrips. An adjustable retainer clip for the putter is shown, as are specially designed compartments for all usual golfing accessories such as shoes, rake/retriever, thermos, umbrella, towel, balls and the like. A rigid, removable cover is provided over the upper end of the bag body. The lower end may include a rotatable base further provided with rollers useful for rolling the bag along airport concourses and the like.

The principles of the invention will be further discussed with reference to the drawings wherein a preferred embodiment is shown. The specifics illustrated in the drawings are intended to exemplify, rather than limit, aspects of the invention as defined in the claims.

BRIEF DESCRIPTION OF THE DRAWINGS

In the Drawings

FIG. 1 is a perspective view of a golf bag provided in accordance with principles of the present invention, with the cover exploded therefrom to expose the upper end of the bag body;

FIG. 2 is an opposite-side perspective view showing the cover in place;

FIG. 6 is an enlarge-scale fragmentary perspective view showing the putter mounting clip;

FIG. 7 is a bottom plan view of the bag body;

FIG. 8 is an enlarged scale fragementary cross-sectional view taken on line 8—8 of FIG. 7.

DETAILED DESCRIPTION

Figure 3:
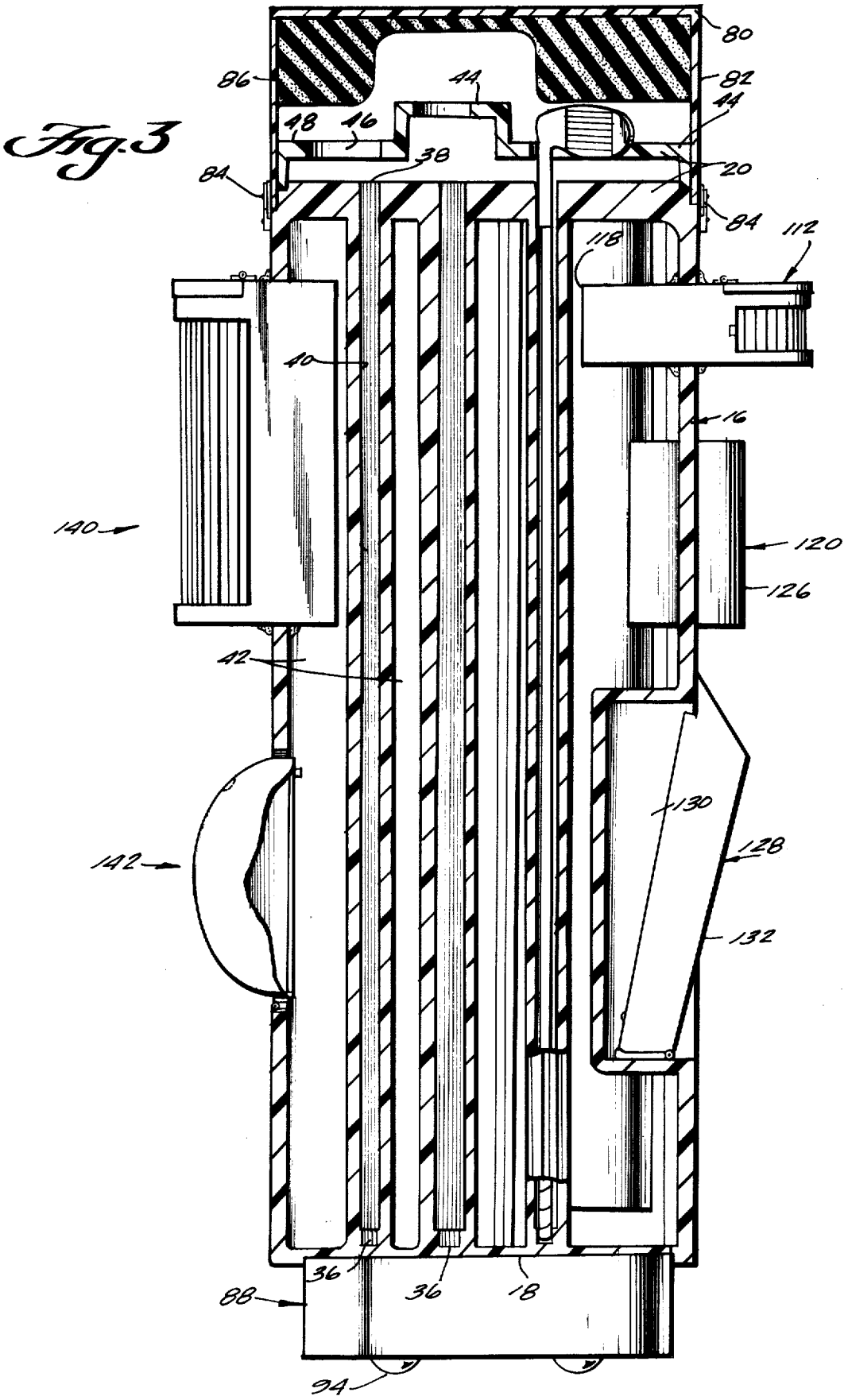
FIG. 3 is a longitudinal cross-sectional view thereof.
Figure 4:
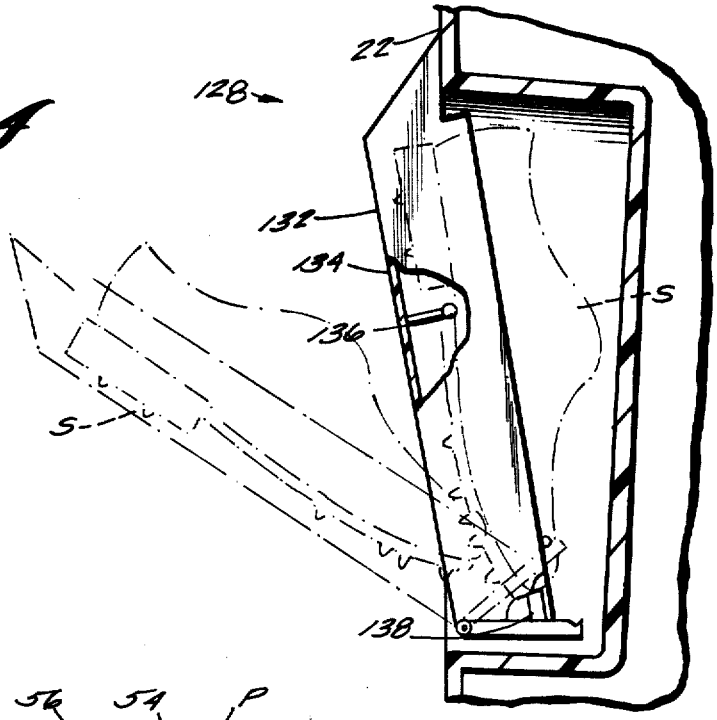
FIG. 4 is a larger scale fragmentary elevational view of the shoe storage region, partly broken away and sectioned.
Figure 5:
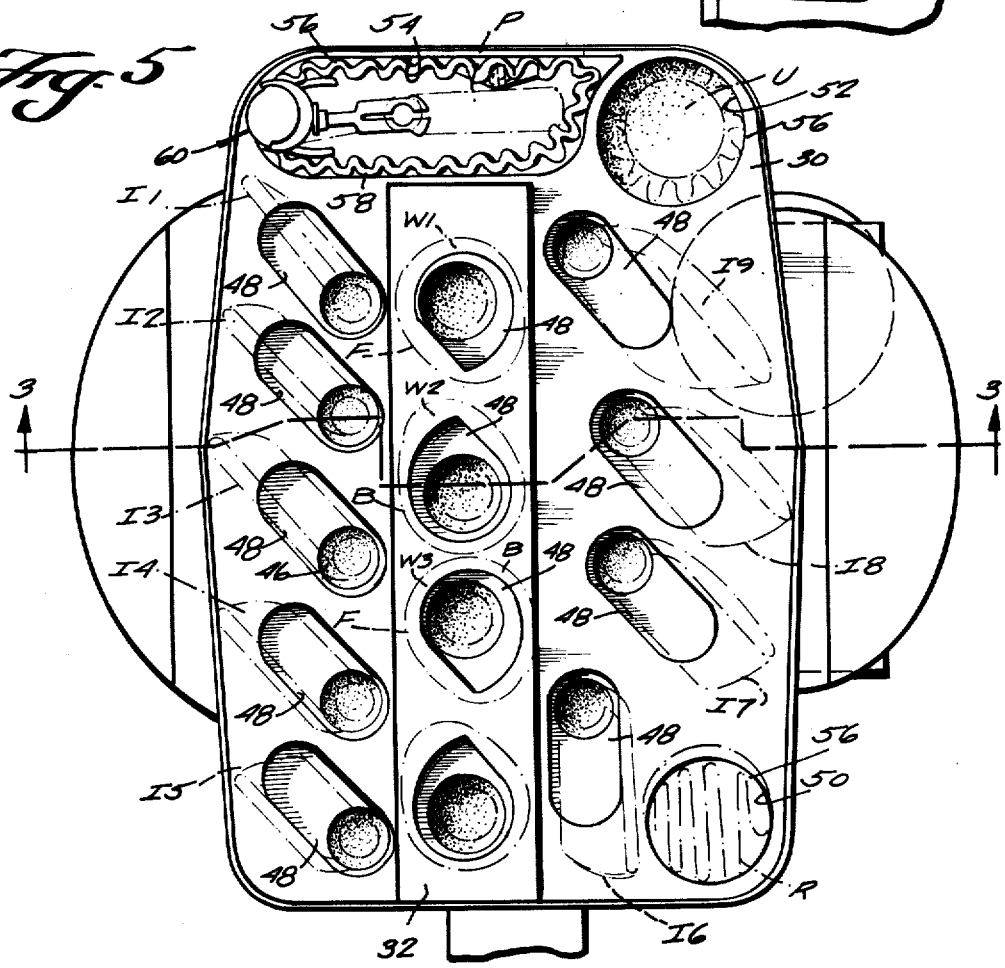
FIG. 5 is a top plan view of the bag body.

The golf bag 10 includes a body 12 and a cover 14. These parts are preferably molded of the same kinds of semi-rigid, tough synthetic plastic material that is used in the manufacture of plastic airline luggage, portable TV cabinets, automobile body parts and the like, and using the same molding techniques.

The body 12 includes a perimetrical sidewall 16 of generally rounded-rectangular plan figure, a bottom wall 18 and a top wall 20. For convenience in description, the broader sides of the body are herein designated the front, 22, and the back 24. The two narrower sides are herein designated the handle end, 26, and the towel end, 28.

The top wall 20 is shown provided with a horseshoe-shaped outer portion 30, bordering the front and rear sides and the towel end, and with a raised center portion 32 bordering the handle end wall 26. This center portion 32 is stepped-up at 34 from the level of the outer portion 30 by approximately the amount that the shaft of the typical longest-shafted wood is longer than the shaft of the typical longest-shafted iron.

The upper, inner side of the bottom wall 18 is shown provided with a plurality of upwardly opening socket-like fixtures 36. The top wall 20 is shown provided with a corresponding plurality of similarly arranged openings 38. A respective tube 40 extends between each fixture 36 and each opening 38. In some instances the walls 18 and 20 and the tubes 40 would all be integrally molded together, perhaps even with some or all of the bag body, but in other instances these parts would be separately molded, then fabricated together e.g. by solvent welding, thermal bonding, adhesive bonding or the like. Fabrication of separately formed parts permits the tubes 40 to form as an extrusion that is cut to length. By preference the tubes 40, or at least those that are to receive club shafts, are longitudinally ribbed so as to be corrugated as seen in transverse cross-section, and radially resilient in order to frictionally resiliently hold the handgrips of the respective clubs received therein, as are the fixtures 36.

The space 42 within the body but outside the tubes 40 may be left empty or may be filled, e.g. with a foamed in situ mechanical shock-cushioning plastic polymer. In fact, the tubes 40 may be formed as an integral, non-foamed skin on such material.

The top wall 20 is shown provided with overlay means, in the form of one or more sculptured blocks 44 e.g. made of integrally-skinned semi-rigid foamed plastic resin or a hollow molded shell of plastic material similar to that used in the manufacture of the sidewall 16. Directly over and perimetrically in the vicinity of each opening 38 in the top wall 20, the block 44 is either missing, or provided with a matching opening 46 or provided with a slot or somewhat funnel-like or otherwise guiding surface 48, leading down to a matching opening 46. It is preferred that for each tube 40 that is to receive the handgrip and shaft of an iron or wood, that the respective guiding surface 48 constitute a cradle which is particularly shaped to permit the inverted top of the respective club head to nestle therein to a depth of, for instance, approximately one-quarter or so of the height of the respective club head.

Each cradle 48, regardless of its specific shape is designed not only to nestle a specific club head, but to accept the club head only when the respective club is guidingly homed thereinto or thereagainst so as to have a pre-selected angular orientation. As shown, it is preferred that the cradles 48 orient the clubs so that the woods, W1–W4, which are received in the single row of four cradles 48 which row runs parallel to the long sides of the top wall, down the center of the raised center portion 32, have their faces F at least generally parallel to one another with the heads of adjoining woods being rotated 180° relative to one another, e.g. so that the faces F of woods W1 and W2 confront one another, the backs B of the heads of woods W2 and W3 confront one another and the faces F of woods W3 and W4 confront one another. (By the designations W1, W2, etc., it is not meant to imply that these are necessarily a ONE wood, a TWO wood, etc., but only to differentiate the four woods a player is permitted to have in the bag during play governed by usual tournament rules. E.g. W1 might, in actual practice, be a FIVE wood, W2 might be a THREE wood, etc.)

Also by preference, the cradles 48 dispose the faces F in a set of at least generally parallel planes which lie at approximately 45° to the sides of the bag top wall.

Likewise by preference, five of the cradles 48 are provided at least approximately in a row on that leg of the outer portion 30 of the top wall 20 which lies between the raised center portion 32 and the back wall 24, this row extending at least generally parallel to those structures and having its five cradles 48 shaped to receive, in order, the five lowest-numbered irons, here designated I1–I5, with the longest-dimensioned axis of each club head oriented to project obliquely outwards, away from the adjoining row of woods, along planes parallel to those of the faces of the woods W1–W4. Further by preference, the remaining four of the cradles 48 are provided at least approximately in a row on the opposite leg of the outer portion 30 of the top wall 20, this row extending at least generally parallel to the other two and having its four cradles 48 shaped to receive, in order, the four highest-numbered irons, here designated I6–I9, with the longest-dimensioned axis of each club head oriented to project obliquely outwards, away from the adjoining woods W1–W4, along planes parallel to those of the faces of the woods. This preference clearly is not a slavish one; note that the cradle for the head of club I6 is oriented to point the club head more toward the handle end wall of the bag body (in order to avoid interference with another feature).

The preference for forming the block or blocks 44 separately, then adhering or otherwise securing it or them in place upon the wall 20 is to facilitate mass manufacture, it being thereby possible to make the same basic bag 10 in larger quantities, and to customize it to accept the club heads of each particular golfer by making the block(s) 44 to order, or in a range of different styles. Of course it would be possible, if desired, to form the cradles 48 directly in the top wall 20 and to eliminate the provision of the block or blocks 44. A middle way would be to mold-in cradles for the woods W1–W4, but provide a sculpture block or blocks for cradling the irons I1–I9. The deck of the bag 10 whether constituted by the top wall 20 or one or more sculpture blocks 44, or both, may include additional openings which provide the mouths for additional sockets, tubes, wells or the like. Three are illustrated, being openings 50, 52 and 54, respectively for removably receiving a conventional rake/ball retriever tool R, an umbrella U, and a putter P. Each respective tube 56 has an open upper end mounted to the deck perimetrically of the respective opening, and a lower end fixed to the bottom wall 18.

If desired, any or all of the tubes 40, 56 may be supported at a level above their lower ends, instead of or in addition to being supported at their lower ends, e.g. by passing through an apertured plate (not shown) mounted at an intermediate level in the bag body.

Any or all of the tubes 56 may be provided with interior grippers such as corrugations 58 for frictionally gripping the element R, U or P removably received therein.

The well 54/56 for the putter P is shown provided with an adjustable securement assembly 60 for releasably gripping the throat of the shaft of the putter P. In the preferred embodiment shown, the assembly 60 includes a bracket 62 adapted to be mounted to the bag sidewall 16 at the desired height e.g. by installing nut and bolt assemblies 64 through selectively aligned openings 66, 68 in the bracket 62 and bag sidewall 16 (and respective tube 56, if necessary). A universal joint ball 70 is based on the bracket 62. A universal joint socket 72 is mounted on the ball 70. A clip 74 is mounted on the socket 72 via a fixture 76 which, if tightened via the knurled collar 78 fixes the socket 72 to the ball 70, but which, if loosened, permits the socket 72 to be swiveled on the ball 70. Thus, in an initial adjustment to accommodate a particular putter P, the bracket 62 is placed at an acceptable height and is secured in place using the fasteners 64, then the socket 72 is swiveled on the ball 70 until the clip 74 is disposed at the proper place at the mouth of the well 54/56 to receive the throat of the putter P. Then the collar 78 is tightened to lock-in this position. Accordingly, the putter may be easily slid into the well 54/56 and its throat frictionally laterally urged into the clip 74 for dispositioning the putter head in view for ready access. Removal of the putter is accomplished by grasping its head, urging the throat laterally out of the clip and longitudinally withdrawing the putter upwards out of the well 54/56.

If desired, the well for the putter could be made more similar to the wells for the other club, with the adjustable securement assembly being replaced by a respective cradle similar to the cradles 48. Conversely, others of the wells could be provided with adjustable securement assemblies in lieu of cradles, if desired.

The cover 14 preferably is molded as an integral member of the same material as the body 12. It includes an end wall 80 and a perimetrical skirt 82. Toggle fasteners 84, such as are used to fasten the halves of luggage shells to one another are provided between the cover skirt 82 and the body sidewall 16 at a level near the top wall 20 where the cover, when in place, skirts the body sidewall. Accordingly, by preference, the cover 14 may be entirely removed by unfastening the toggle fasteners 84. When in place, the cover 14 completely encloses the deck and thus covers over all of the club heads and tools which are exposed on the deck. In order to further protect the clubs and tools in transit, the cover 14 preferably is provided with a liner 86 of resilient foamed plastic material, e.g. of the type conventionally used for cushioning camera equipment in the carrying cases of professional photographers.

By preference, the body 12 includes a base 88 in the form of a turntable 90 mounted to the bottom wall 18 via a turntable bearing assembly 92, which may be of a conventional type used in the manufacture of swivel furniture (bearing balls trapped between two ring-shaped races respectively fixed to the turntable and to the bag bottom wall. Accordingly, when the bag is upright and resting on the base 88, the user need not reach around the bag to gain access to a particular club, tool or accessory, but may instead manually rotate the bag on the base until the element the user wishes to gain access to is readily at hand. Means (not illustrated in detail) could be provided to lock the base against rotation for instances when it is desired that the bag not be rotatable relative to the base.

As shown, the bottom of the turntable plate is provided with a plurality of semi-recessed castors 94, preferably of the same ball-transfer type that is conventionally used to the bottoms of luggage (and for the same purpose: to facilitate baggage transfer along airport concourses and the like, by permitting the transferor to roll the bag along on its castors). When provided, the castors 94 are preferably equipped with removable caps 96 which, as shown, may be hinged to the bottom of the turntable at 98 and adapted to be received in recesses 100 when not in use. Thus, when it is desired to stabilize the bag against being able to roll, the caps 96 are readily folded about their hinges 98 and snapped in place covering the respective castors 94.

What remains to be described are various accessory features, preferably provided as shown in and about the sidewall 16 of the bag body 12.

The handle end wall 26 of the bag body is shown provided with a shoulder strap 102 and a hand grip 104. Either may be molded integrally with the bag body and either may be provided in any other well-known manner, e.g. of leather or of fabric webbing connected by D-rings to anchors provided on the wall 26. The presently preferred hand grip 104 is integrally molded so as to have anatomically conforming surfaces e.g. as illustrated at 106.

The towel end wall 28 of the bag body is shown provided generally in its upper half, with a vertically long, horizontally narrow recess 108. At the top of the recess 108, the wall 28 is provided with a mounting ring for a golfer's towel T and about two-thirds of the way down from the top of the recess 108, the wall 28 is provided, within the recess, with a loop-shaped retainer 110, through which the lower portion of the towel may be pulled when not in use. The loop 110 functions in much the way that a tieback for window drapes releasably keeps them back out of the way.

The front wall 22 of the sidewall 16 is shown provided with three accessory features that are discretely located in serially, axially spaced relation along the median of the front wall 22. From the top, these features include a bay-window-like compartment 112 with a horizontally slidable tambour door 114 on the front and a snap-open, snap-closed, hinged lid 116. The internal wall 118 of this compartment is shown in FIG. 3, from which it will be seen that the inner, approximately half of the volume of this compartment and its wall 118 take up a portion of the space within the bag body that lies outside the various tubes and wells for clubs and tools. Next below the compartment 112 is a vertically-oriented cylindrical compartment 120 sized and shaped to receive a Thermos jug J or the like. To this end, the internal wall 122 thereof includes a shelf 124 and the resulting well is closed by a complementarily semi-cylindrical snap-closed door 126. Near the bottom is a shoe storage compartment 128 having an internal wall 130 and a bin-type front member 132. The latter is pivotally mounted in the recess defined by the internal wall 130 to pivot about a horizontal axis near its lower edge, between a closed position wherein the front wall 134 is more nearly flush with the golf bag body front wall 22, and an open position, in which its upper end is particularly tilted out so that access may be gained to the shoe storage compartment that is defined between the inner face of the front wall 134 and the internal wall 130. The access door 132 may be provided with a friction fit for retaining it in the open and closed position in which it is placed, and/or it may be provided with securement means such as a snap fastener or the like (not shown in detail). The front member 132 may be removably mounted to the bag body so that when the front member 132 is tilted out it may be entirely removed in much the same way that a desk drawer can be conventionally removed from a desk by fully opening it, then performing an auxiliary maneuver, such as tilting to a different angle and pulling some more.

By preference, the front member includes means for removably securing thereto the golfer's shoes S which may be carried in the compartment 128. These means are shown including two opposed pairs of spring-urged plungers 136. The plungers pairs are arranged to each frictionally grip a shoe laterally between them by resiliently, opposingly engaging it e.g. between vamp and sole at about the narrowest part. The front member 132 further includes an internal ledge 138 on which the shoes S rest, toe-down, when received in the compartment 128.

The back wall 24 of the bag body sidewall 16 is shown including compartments 140 and 142 which may be respectively similar to the compartments 112 and 120, although possibly differently oriented, sized and/or proportioned.

The internal walls of all the compartments may be integrally molded with the bag body sidewall, or may be separately molded, and fabricated into appropriately corresponding openings molded or cut into the bag body sidewall. The various compartment doors may be integrally hinged to frames mounted to the sidewall perimetrically of the various compartment recesses, or may be otherwise hinged or mounted for opening, closing, and for securement in a closed condition. Where necessary or desired, locks may be provided against all access to the bag contents via compartment doors and cover.

It should now be apparent that the golf bag as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompass-all such modifications as are within the spirit and scope of the following claims.

What is claimed is:

1. A golf bag, comprising:

a body including a generally tubular perimetrical sidewall and a lower end wall providing an interior space;

means providing an upper deck for said body;

means providing a plurality of individual generally longitudinally oriented wells in said interior space, each opening through said deck and being adapted to axially slidingly removably receive an elongated item of golfing equipment such as a golf club shaft, handle end first;

means on said deck individually associated with each of at least several of said wells for removably accepting and holding a respective golf club head means;

each said well being constituted by a respective tube having opposite ends mounted and extending between said deck and said lower end wall;

at least one of said tubes including means extending throughout a portion of the length thereof constructed and arranged for resiliently gripping a corresponding portion of the respective golf club when such respective golf club is received handle end first into such tube;

said sidewall including at least one handle means whereby said golf bag may be hand-carried; and cover means including a cover and securement means for releasably securing the cover to the sidewall in domed enclosing relation to said deck.

2. The golf bag of claim 1, wherein:

said body is made of molded semi-rigid material.

3. The golf bag of claim 2, wherein:

said cover is made of molded semi-rigid material.

4. The golf bag of claim 3, wherein:

said cover includes a liner of resilient cushioning material.

5. The golf bag of claim 1, wherein:

at least one of said accepting and holding means comprises an upwardly opening cradle formed in said deck where the respective said well opens through said deck, said cradle being asymetrically shaped angularly of such opening, in a sense such as to socketingly receive the top of a respective golf club head only when, as such golf club while being received handle-end first in the respective said well is guided to assume a unique angular orientation about the longitudinal axis of its shaft.

6. The golf bag of claim 5, wherein:

a respective said cradle is provided for each of nine said wells, which are shaped to receive the backs of a series of nine respective irons.

7. The golf bag of claim 6, wherein:

a further respective said cradle is provided for each of four said wells, which are shaped to receive the backs of a series of four respective woods.

8. The golf bag of claim 7, wherein:

said cradles are grouped in respective clusters, with the said cradles for the irons flanking a centrally located cluster of respective said cradles for the woods.

9. The golf bag of claim 8, wherein:

the deck is of split-level form, with an upper level for said cluster of cradles for the woods, and a lower level for said cradles for the irons.

10. The golf bag of claim 9, wherein:

said cradles are provided in three rows, consisting of a central row having said upper level and two flanking rows for said lower level.

11. The golf bag of claim 10, wherein:

the cradles for the woods are angularly oriented to face the woods in two groups of two facing woods with faces disposed approximately diagonally to a rectangular array defined by said three rows; and the cradles for the irons are angularly oriented to face the irons at least generally parallel to the woods.

12. The golf bag of claim 5, wherein:

said body includes an upper end wall with said deck comprising a separately-formed sculptured block means mounted thereon, said wells opening through said upper end wall and each said cradle being formed in said sculptured block means.

13. The golf bag of claim 5, wherein:

at least another of said accepting and holding means comprises an adjustably-mounted clip mounted to said body and juxtaposed with where the respective well opens through said deck;

said clip being constructed and mounted to releasably grip a putter, in the putter head region, when such putter is inserted handle end first into the respective well.

14. The golf bag of claim 1, wherein:

said at least one tube is corrugated for resilient radial expansion throughout at least a portion of the length thereof for adapting that tube to resiliently grip a corresponding portion of the respective golf club when received handle end first into such tube.

15. The golf bag of claim 1, wherein:

the body further includes a base underlying said bag body lower end wall, said base comprising a turntable plate and turntable bearing means securing the turntable plate to the bag body for providing for rotation of the body but for the base as said golf bag rests on said base.

16. The golf bag of claim 15, wherein:

the turntable further includes a plurality of angularly distributed, rollable castors, so that the golf bag rests on said base for instance while being transported through an airport terminal, said golf bag may be rolled-along on said castors.

17. The golf bag of claim 16, wherein:

said castors are of the ball transfer type.

18. The golf bag of claim 16, further including:

cap means movably mounted on said turntable for removably covering the castors for temporarily isolating them from use.

19. The golf bag of claim 1, further including:

a vertically elongated external recess formed in said sidewall;

fastener means on said sidewall near the top of said recess, for securing a golfer's towel to said golf bag for storage in said recess.

20. The golf bag of claim 19, further including:

a keeper means for releasably keeping such golfer's towel stowed in said recess when such towel is not in use.

21. The golf bag of claim 19 wherein:

said sidewall is of generally rectangular figure in plan, so as to have two pairs of opposed walls, including a front wall, a rear wall, a handle end wall and a towel end wall;

said handle means being based on said handle end wall and said recess being provided on said towel end wall.

22. The golf bag of claim 1, wherein:

said body is made of molded, semi-rigid material and said sidewall incorporates a compartment which is partially recessed into said space and which includes an internal wall at least partially isolating such compartment from the remainder of said space; such compartment further including a movably mounted openable closure member.

23. The golf bag of claim 22, wherein:

the openable closure member is a hinged snap lid.

24. The golf bag of claim 22, wherein:
the openable closure member is a tambour door.
25. The golf bag of claim 22, wherein:
the openable closure member is a hinged cover door.
26. The golf bag of claim 22, wherein:
said openable closure is a pivoted bin front panel member having an interior face provided with means for removably mounting a pair of golfer's shoes thereto for storage within the respective compartment.
27. The golf bag of claim 26, further including:
a ledge on said bin front interior face for supporting such shoes when so mounted to said bin front panel member.
28. The golf bag of claim 26, wherein:
said means for removably mounting the golfer's shoes include opposed pairs of spring-loaded plungers mounted on said bin front panel member.
29. The golf bag of claim 22, wherein:
the compartment is sized and shaped to removably receive a pair of golfer's shoes.
30. The golf bag of claim 22, wherein:
the compartment is sized and shaped to removably receive a thermally insulated, generally cylindrically shaped food and beverage container.
31. The golf bag of claim 1, wherein:
one of said wells is constructed and arranged to removably, slidingly receive a golfer's umbrella.
32. The golf bag of claim 1, wherein:
one of said wells is constructed and arranged to removably, slidingly receive a golfer's ball retriever/rake tool.

* * * * *